US008079153B2

(12) United States Patent
Pulkrabek et al.

(10) Patent No.: US 8,079,153 B2
(45) Date of Patent: Dec. 20, 2011

(54) BOW SIGHT AND EYE ALIGNMENT ASSEMBLY WITH TAPERED FRAME

(75) Inventors: Larry Pulkrabek, Osceola, IA (US); Jay Engstrom, Port Wing, WI (US)

(73) Assignee: Field Logic, Inc., Superior, WI (US)

( * ) Notice: Subject to any disclaimer, the term of this patent is extended or adjusted under 35 U.S.C. 154(b) by 0 days.

(21) Appl. No.: 12/941,229

(22) Filed: Nov. 8, 2010

(65) Prior Publication Data

US 2011/0167655 A1 Jul. 14, 2011

Related U.S. Application Data

(63) Continuation-in-part of application No. 12/791,503, filed on Jun. 1, 2010, which is a continuation-in-part of application No. 12/726,594, filed on Mar. 18, 2010, now Pat. No. 7,814,668, which is a continuation-in-part of application No. 12/684,775, filed on Jan. 8, 2010, now Pat. No. 7,921,570.

(51) Int. Cl.
*F41G 1/467* (2006.01)

(52) U.S. Cl. ..... 33/265; 124/87

(58) Field of Classification Search ..... 33/263, 33/265

See application file for complete search history.

(56) References Cited

U.S. PATENT DOCUMENTS 4,400,887 A 8/1983 Mason
4,764,011 A 8/1988 Goldstein
4,928,394 A 5/1990 Sherman
5,025,565 A * 6/1991 Stenerson et al. ..... 33/265
5,080,084 A 1/1992 Kendall et al.
5,157,839 A 10/1992 Beutler
5,168,631 A 12/1992 Sherman
5,201,124 A 4/1993 Sherman
5,231,765 A 8/1993 Sherman
5,303,479 A 4/1994 Rudovsky
5,308,986 A 5/1994 Walker
5,338,037 A 8/1994 Toyohara
5,384,966 A 1/1995 Gibbs
5,420,959 A 5/1995 Walker et al.
5,428,901 A * 7/1995 Slates ..... 33/265
5,442,861 A 8/1995 Lorocco
5,560,113 A 10/1996 Simo et al.
5,606,638 A 2/1997 Tymianski et al.
5,638,604 A 6/1997 Lorocco (Continued)

OTHER PUBLICATIONS

Vital Gear 2007 Product Catalog.

*Primary Examiner* — G. Bradley Bennett
(74) *Attorney, Agent, or Firm* — Stoel Rives, LLP

(57) ABSTRACT

A sighting device for a bow (or other tool) that includes an eye alignment assembly. A frame is attached to the bow using a mounting bracket. The frame includes a leading edge oriented toward a user, a trailing edge oriented down range of the bow, and a tapered inner surface generally surrounding a viewing opening. The tapered inner surface tapering outward from the leading edge toward the trailing edge. A plurality of sight points on sight pins are located in the viewing opening. The sight points are configured to align the bow with a target viewed through the viewing opening. The eye alignment assembly includes the tapered inner surface substantially concealed behind the leading edge when the frame is located at a particular orientation relative to the user's eye.

17 Claims, 18 Drawing Sheets

U.S. PATENT DOCUMENTS 5,649,526 A 7/1997 Ellig
5,685,081 A 11/1997 Winegar
5,850,700 A 12/1998 Capson et al.
5,862,603 A 1/1999 Ellig
RE36,266 E 8/1999 Gibbs
5,956,854 A 9/1999 Lorocco
6,000,141 A 12/1999 Afshari
6,016,608 A 1/2000 Lorocco
6,024,079 A * 2/2000 Ingle et al. ..... 124/87
6,122,833 A 9/2000 Lorocco
6,216,352 B1 4/2001 Lorocco
6,311,405 B1 11/2001 Slates
6,360,472 B1 3/2002 Lorocco
6,385,855 B1 5/2002 Tymianski
6,421,946 B1 7/2002 Lorocco
6,477,778 B1 11/2002 Lorocco
6,477,780 B2 11/2002 Aldred
6,557,291 B2 5/2003 Hoadley
6,560,884 B1 5/2003 Afshari
6,564,462 B1 5/2003 Henry
6,571,482 B1 6/2003 Tymianski
6,581,317 B1 6/2003 Slates
6,581,347 B1 6/2003 Slates
6,634,110 B2 10/2003 Johnson
6,634,111 B2 10/2003 Lorocco
6,725,854 B1 4/2004 Afshari
6,796,037 B1 9/2004 Geffers et al.
6,802,129 B1 10/2004 Wirth
6,817,105 B2 11/2004 Lorocco
6,938,349 B2 9/2005 Afshari
6,981,329 B1 1/2006 Strathman
7,036,234 B2 5/2006 Rager
7,200,943 B2 4/2007 Afshari
7,290,345 B2 11/2007 Ellig
7,331,112 B2 2/2008 Gibbs
7,461,460 B2 12/2008 Priebe
7,464,477 B2 12/2008 Afshari
7,503,321 B2 3/2009 Afshari
7,562,486 B2 7/2009 Lorocco
7,574,810 B1 8/2009 Lorocco
7,574,811 B2 8/2009 Kurtzhals et al.
2003/0110647 A1 6/2003 Henry
2004/0111900 A1* 6/2004 Rager ..... 33/265
2007/0028467 A1 2/2007 Bradley et al.
2009/0199418 A1 8/2009 Lorocco
2011/0186028 A1* 8/2011 VandeWater ..... 124/87
2011/0214304 A1* 9/2011 Priebe ..... 33/265
2011/0252654 A1* 10/2011 Edmundson ..... 33/265

* cited by examiner

BOW SIGHT AND EYE ALIGNMENT ASSEMBLY WITH TAPERED FRAME

RELATED APPLICATIONS

The present application is a continuation-in-part of U.S. patent application Ser. No. 12/791,503 entitled EYE ALIGNMENT ASSEMBLY WITH PHOSPHORESCENT FIBER, filed Jun. 1, 2010, which is a continuation-in-part of U.S. patent application Ser. No. 12/726,594 entitled EYE ALIGNMENT ASSEMBLY, filed Mar. 18, 2010, which is a continuation-in-part of U.S. patent application Ser. No. 12/684,775 entitled EYE ALIGNMENT ASSEMBLY FOR TARGETING SYSTEMS, filed Jan. 8, 2010, the entire disclosures of which are hereby incorporated by reference.

FIELD OF THE INVENTION

The present disclosure is directed to a sighting device, such as for example a bow sight, with an eye alignment assembly. The eye alignment assembly includes the tapered inner surface substantially concealed behind the leading edge when the frame is located at a particular orientation relative to the user's eye. The eye alignment assembly provides an indication of orientation of a user's eye in the pitch and yaw directions relative to the bow. The eye alignment assembly assists the user to consistently positions her body in the correct orientation relative to the bow (or any other tool), so that over time the bow becomes an extension of the user's body.

BACKGROUND OF THE INVENTION

Humans use a wide variety of tools where the orientation of the tool relative to the user is critical to safe and effective operation. For example, the orientation of a bow or gun relative to a shooter will determine the accuracy and repeatability of a shot. Golfers spend a great deal of time positioning themselves relative to the golf ball and golf clubs in order to develop a consistent and repeatable golf swing. In board riding athletic activities, such as skiing, surfing, snowboarding, windsurfing, and the like, the posture and position of the rider relative to the board is critical. Free-hand power tools, such as drills, planners, routers and saws, operate best and safest when consistently positioned relative to the user's body.

For many tools, however, it is not possible to align the user's line of sight with an operating axis/plane of the tool. Rather, the operating axis/plane of the tool and the line of sight of the user need to converge at a particular location. For example, the operating axis of a pool cue is along the axis of the cue. The pool player does not sight along the operating axis of the pool cue. Rather, the pool player's line of sight and the operating axis of the pool cue converge, typically at the cue ball. In another example, the operating axis of a bow is co-linear with the arrow. Modern bows, however, do not permit the user to sight along the axis of the arrow. Consequently, the user must position his or her body in a fixed relationship with the bow, as a surrogate to sighting along the operating axis of the arrow.

Over time a user can develop the skill to make the tool an extension of his or her body so the operating axis/plane of the tool and the user's line of sight converge in the correct location. The current mechanisms for accelerating this learning process, however, are crude and inaccurate.

Using archery as an example, the alignment of a shot can vary dramatically depending on where the archer positions his or her head, or more particularly, his or her shooting eye relative to the bow. If the archer's eye position varies from shot to shot, so will the accuracy and direction of each respective shot, leading to inconsistent or unpredictable shooting. U.S. Pat. No. 5,850,700 proposes an eye alignment apparatus that assures that the archer's shooting eye is consistently positioned relative to the bow and the bow sight, which is hereby incorporated by reference.

BRIEF SUMMARY OF THE INVENTION

The present disclosure is directed to a sighting device, such as a bow sight, with an eye alignment assembly. The eye alignment assembly provides an indication of orientation of a user's eye in the pitch and yaw directions relative to the bow. The eye alignment assembly assists the user to consistently positions her body in the correct orientation relative to the bow (or any other tool), so that over time the bow becomes an extension of the user's body.

In one embodiment, the sighting device includes a mounting bracket adapted to attached to the bow. A frame is attached to the mounting bracket. The frame includes a leading edge oriented toward a user, a trailing edge oriented down range of the bow, and a tapered inner surface generally surrounding a viewing opening. The tapered inner surface tapering outward from the leading edge toward the trailing edge. A plurality of sight points on sight pins are located in the viewing opening. The sight points are configured to align the bow with a target viewed through the viewing opening. The eye alignment assembly includes the tapered inner surface substantially concealed behind the leading edge when the frame is located at a particular orientation relative to the user's eye.

The eye alignment assembly provides an indication of orientation of the user relative to the bow in at least two degrees of freedom, such as the pitch and yaw directions. The eye alignment assembly decouples the user's line of sight from an operating axis/plane of the bow. The eye alignment assembly also provides an indication of orientation of a user relative to the bow without aligning the user's line of sight with an operating axis/plane of the bow. In one embodiment, indicia are provided proximate the trailing edge to assist the user in positioning the tapered inner surface substantially behind the leading edge.

In one embodiment, the mounting bracket includes a bow portion pivotally attached to the bow at a first location, a slot in the bow portion, and a traveler located in the slot and attached to the bow at a second location. The bow portion can pivot around the first location while the travel slides in the slot. A spring biases the bow portion is a first direction of rotation. A set screw counteracts the bias of the spring to rotate the bow portion is a second opposite direction. The mounting bracket preferably permits the frame to be adjusted in both pitch and roll relative to the bow (or other tool).

In one embodiment, a secondary eye alignment assembly is mounted to the frame. The secondary eye alignment assembly includes a sight point of an optical fiber positioned a distance behind an alignment indicia on a lens. An adjustment system is adapted to reposition the sight point of the optical fiber relative to the alignment indicia on the lens. The secondary eye alignment assembly provides an indication of orientation of the user relative to the tool in at least two degrees of freedom.

The adjustment system permits the sight point of the optical fiber to be adjusted in at least two degrees of freedom relative to the lens. The lens optionally includes a magnification such that the sight point is only in focus when the lens is a predetermined distance from a user. In one embodiment, alignment indicia rotates relative to the lens to provide an indication of level. The alignment indicia on the lens is aligned with the sight point on the optical fiber only when the user is in a predetermined relationship with respect to the tool. In some embodiments, the secondary eye alignment assembly provides an indication of the user's position relative to the bow in six degrees of freedom.

The present disclosure is also directed to a sighting device for a tool. A mounting bracket is adapted to attached to the tool. A frame is attached to the mounting bracket. The frame includes a leading edge oriented toward a user, a trailing edge oriented away from the user, and a tapered inner surface generally surrounding a viewing opening. The tapered inner surface tapers outward from the leading edge toward the trailing edge such that the tapered inner surface is substantially concealed behind the leading edge when the frame is located at a particular orientation relative to the user's eye. The tool can be one of a bow, a firearm, a golf club, power tools, pool cue, tractor, or snow skis.

The present disclosure is also directed to a method of aligning a bow with a user. The method includes the step of mounting a sighting device with an eye alignment assembly to the bow. The eye alignment assembly is positioned with leading edge of a frame is oriented toward a user, a trailing edge oriented down range of the bow, and a tapered inner surface generally surrounding a viewing opening. The tapered inner surface tapers outward from the leading edge toward the trailing edge. The bow is positioned so the tapered inner surface is substantially concealed behind the leading edge. A sight point located in the viewing opening is aligned with a target and the bow is fired.

As used herein, "tool" includes any object that interfaces with a domain to facilitate more effective action. For example, tools include skies that interface with snow, a drill that interfaces with a work piece, a golf club that interfaces with a ball, etc. The operating axis/plane of a tool is located at an optimum interface between the tool and the domain. That interface is typically planar or linear. The present eye alignment assembly provides an indication of the optimum interface of the operating axis/plane of the tool, without requiring the user to align her line of sight with the operating axis/plane of the tool.

In operation, the tapered inner surface is substantially concealed behind the leading edge of the frame only when a user's eye is in a predetermined relationship with respect to the eye alignment assembly, and hence, the tool to which it is mounted. When properly adjusted, the user's line of sight converges with the operating axis/plane of the tool in the optimum location.

DETAILED DESCRIPTION OF THE INVENTION

Figure 1B:
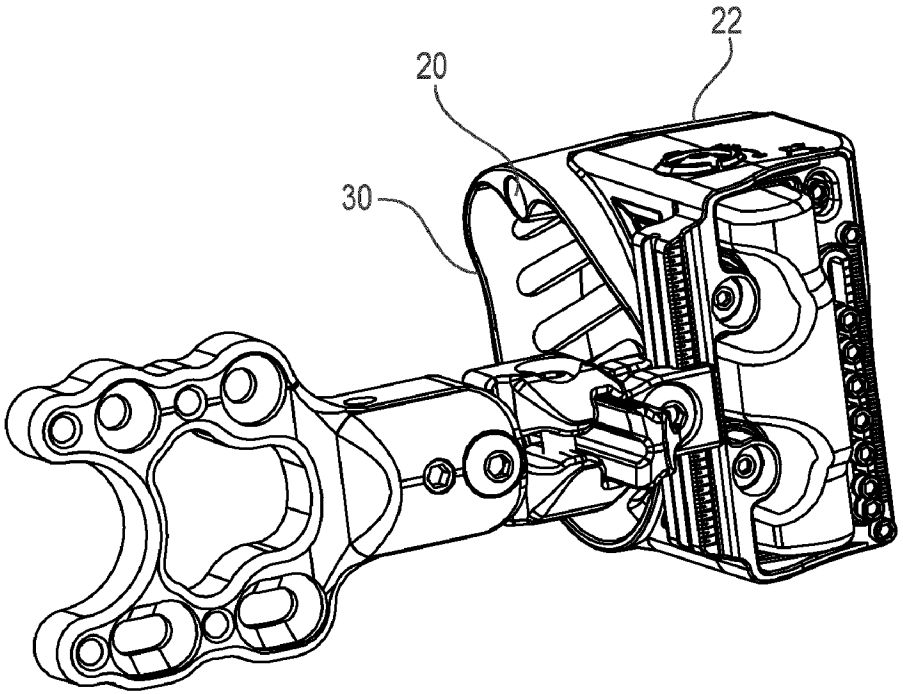
FIGS. 1A and 1B are perspective views of a bow sight with the present eye alignment assembly in accordance with an embodiment of the present disclosure.
Figure 1A:
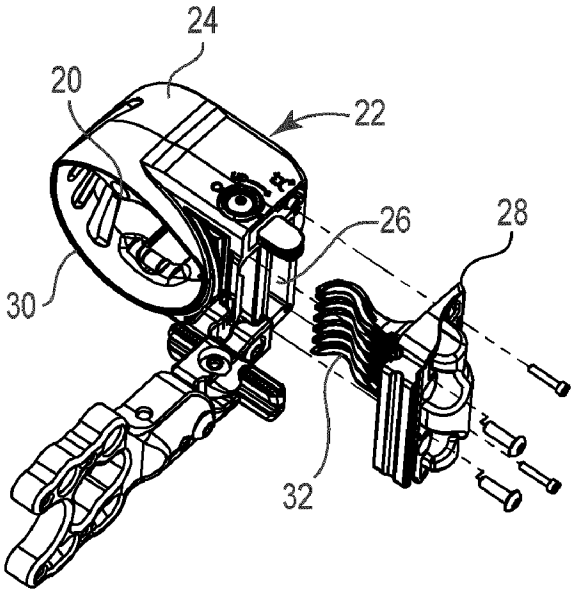

FIGS. 1A and 1B are perspective views of eye alignment assembly 20 mounted to bow sight 22 in accordance with an embodiment of the present disclosure. The bow sight 22 includes frame 24 with recess 26 sized to receive pin assembly 28 and guard 30 to protect sight pin array 32. In the illustrated embodiment, the eye alignment assembly 20 is located in a recess in the frame 24, as will be discussed in detail below.

The eye alignment assembly 20 contemplated by this disclosure is not used as a sighting or aiming device. Rather, the eye alignment assembly 20 is used in combination with the bow sight 22 to provide an indication of orientation of a user's eye relative to the bow sight 22. Over time, the user learns to quickly and accurately position his or her body and shooting eye in the same position relative to the bow sight 22, allowing for consistent shooting.

Figure 1C:
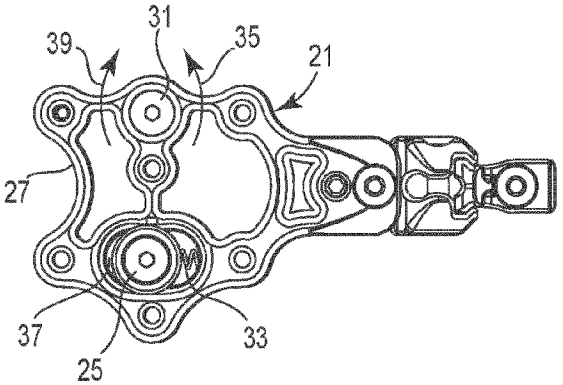
FIGS. 1C and 1D illustrate an alternate mounting assembly for a bow sight in accordance with an embodiment of the present disclosure.
Figure 1D:
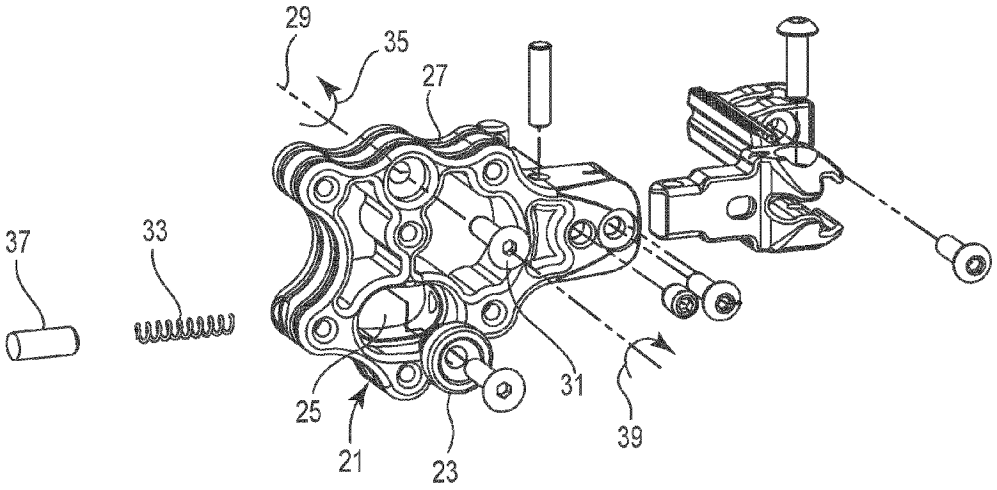

FIGS. 1C and 1D illustrate an alternate mounting assembly 21 in accordance with an embodiment of the present disclosure. Traveler 23 located in slot 25 permits the bow portion 27 to pivot around axis 29 of mounting screw 31. Spring 33 biases bow portion 27 in direction 35. Set screw 37 can be adjusted to move the bow portion 27 in the opposite direction 39, thereby controlling the position of the traveler 23 within the slot 25. The present mounting assembly 21 permits the user to precisely control the angle of rotation relative to the mounting hole on the bow. This adjustment is preferably made before adjusting the eye alignment assembly 20, discussed below.

Figure 2A:
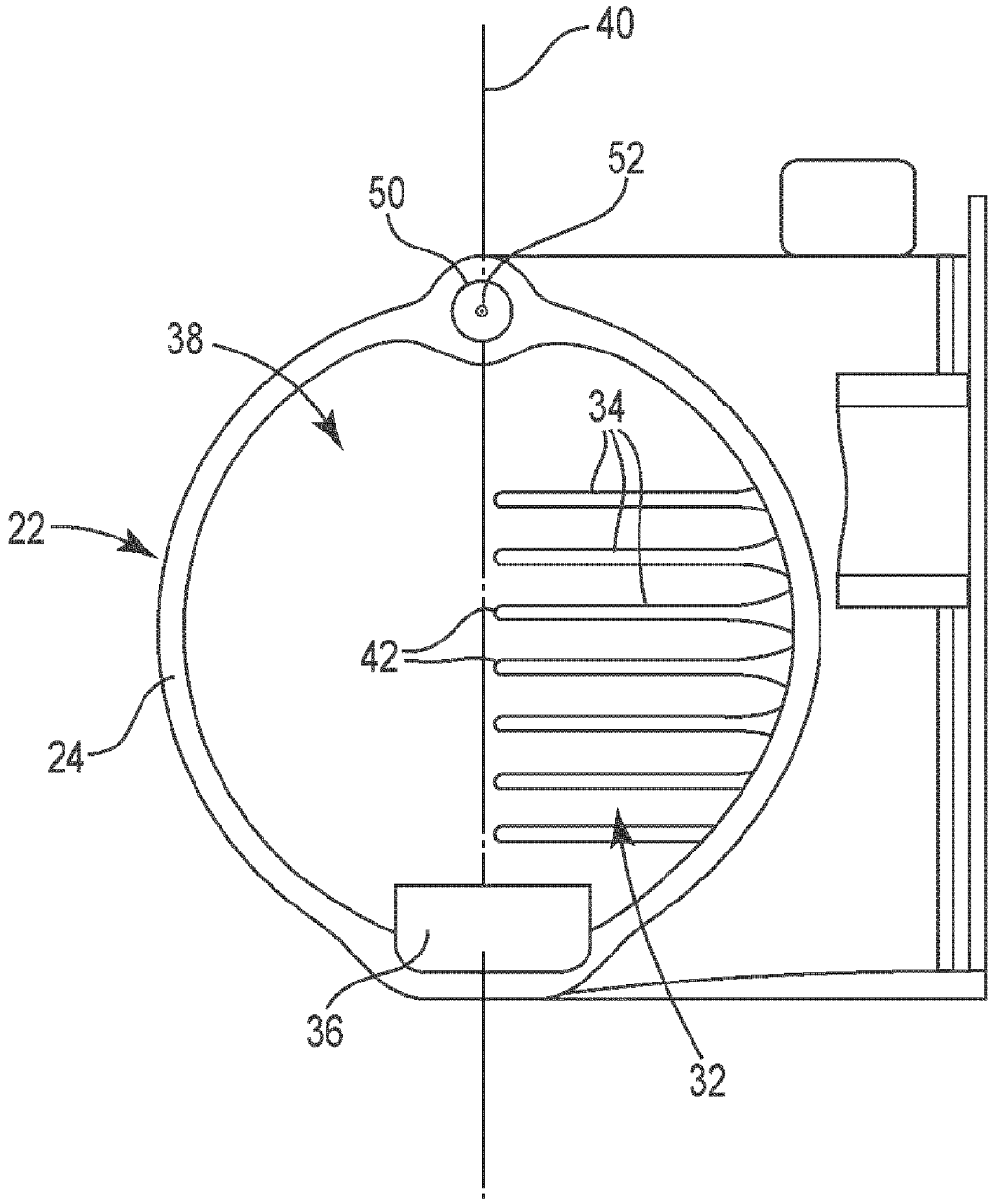
FIG. 2A is a front view of the eye alignment assembly of FIGS. 1A and 1B viewed from a user's perspective.

FIG. 2A is a rear view of the bow sight 22 as seen by the archer during use. The sighting pins 34 in the sight pin array 32 are visible within frame 24. Bubble level 36 is mounted in frame 24 to provide an indication of orientation of the bow sight 22 in the roll direction relative to horizontal.

Eye alignment assembly 20 is mounted in the frame 24 to provide an indication of orientation of the bow sight 22 in the pitch and yaw directions relative to the user's eye. Locating the eye alignment assembly 20 on the frame 24 permits the user to check alignment while viewing a target through opening 38 in the frame 24 that surrounds the sighting pins 34. The eye alignment assembly 20 is preferably located along axis 40 formed by the sight points 42.

In the illustrated embodiment, the eye alignment assembly 20 includes a lens 50 fixedly mounted to the frame 24. Alignment indicia 52 on the lens 50 are fixed relative to the sight 22. The initial alignment of the eye alignment assembly 20 relative to the sight 22 is preferably performed at the factory.

Figure 2C:
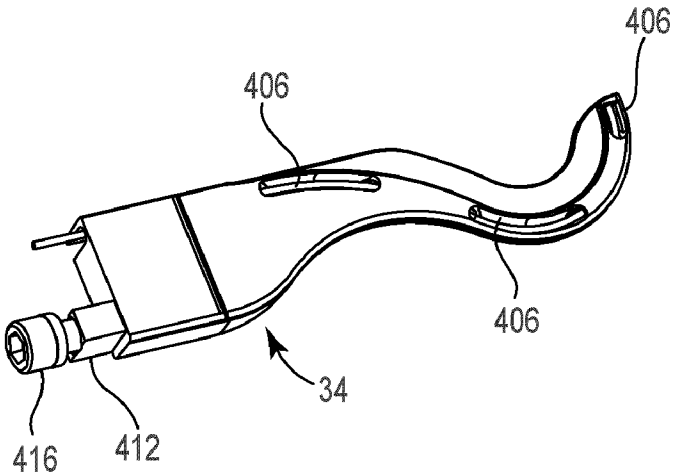
FIGS. 2B and 2C illustrate further details of sight pins shown in FIG. 2A.
Figure 2B:
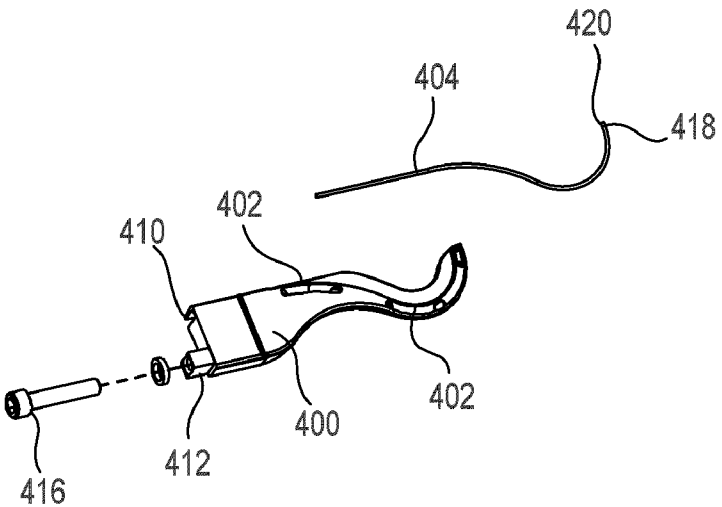

FIGS. 2B and 2C illustrate an individual sighting pin 34 of the sight pin array 32 in accordance with an embodiment of the present disclosure. Pin housing 400 includes channel 402 that retains phosphorescent optical fiber 404. The channel 402 includes a number of openings 406 that permit ambient light to reach the phosphorescent optical fiber 404, while the pin housing 400 protects the phosphorescent optical fiber 404 from damage. Proximal end 410 of the pin housing 400 includes a rectangular portion 412 that couples with a correspondingly shaped pin slot on the pin assembly 28 (see FIG. 1A). Screw 416 engages with threads in the rectangular portion 412 to engage the pin housing 400 with the slot on the pin assembly 28.

Distal end 418 of the phosphorescent optical fiber 404 acts as the sight point 420. In the illustrated embodiment, the phosphorescent optical fiber 404 is about five inches long with a diameter of about 0.0019 inches. Suitable phosphorescent optical fibers are available from NanOptics, Inc. located in Gainesville, Fla. The phosphorescent optical fibers 404 are preferably different colors (e.g., red, green, etc.) to assist the user in distinguishing the different sighting pins 34 in the sight pin array 32. The openings 406 permit that phosphorescent optical fiber 404 to gather ambient light. Once the phosphorescent optical fibers 404 are charged, they will illuminate the sight point 420 for hours.

The present bow sight 22 automatically adapts to the lighting conditions. The brightness of the phosphorescent optical fibers 404 relative to daylight conditions is very low. Consequently, when ambient light is high the phosphorescent material contributes a relatively small percentage of the light delivered to the sight point 420. In low light conditions, however, the brightness of the phosphorescent optical fiber 404 is significant compared to the ambient light and the luminescent material contributes a relatively large percentage of the light delivered to the sight pin 420.

FIGS. 3A, 3B, 3C, and 3D illustrate one embodiment of the eye alignment assembly 20 in greater detail. Pin housing 60 supports phosphorescent optical fiber 62 so sight point 64 is generally aligned a fixed distance behind alignment indicia 52 on the lens 50. The sight point 64 serves as the second alignment indicia. The alignment indicia 52 can be a point, a circle, cross-hairs, or a variety of other configurations. The term "sight point" is used herein to generically refer to a portion of a phosphorescent optical fiber. The sight point can be one or more ends of the phosphorescent optical fiber or a side edge.

Sensitivity of the eye alignment assembly 20 can be adjusted by changing the distance between the sight point 64 and the lens 50. The closer the sight point 64 is to the lens 50, the more sensitive the eye alignment assembly 20 will be. Sensitivity can also be adjusted by adding magnification to the lens 50.

When alignment indicia 52 on lens 50 is aligned with sight point 64 on phosphorescent optical fiber 62, the user's eye is in a predetermined relationship with respect to the eye alignment assembly 20, and hence, the sight 22. That is, alignment indicia 52 and sight point 64 can only be viewed in a predetermined way from a predetermined approximate angle, assuring that the archer's shooting eye is consistently positioned relative to the illuminated sight 22.

The eye alignment assembly 20 permits adjustment of the position of the sight point 64 relative to alignment indicia 52 on the lens 50 along axes 70, 72. The adjustment system permits the eye alignment assembly 20 to be easily adjusted for the shooting style of a particular shooter.

Figure 3A:
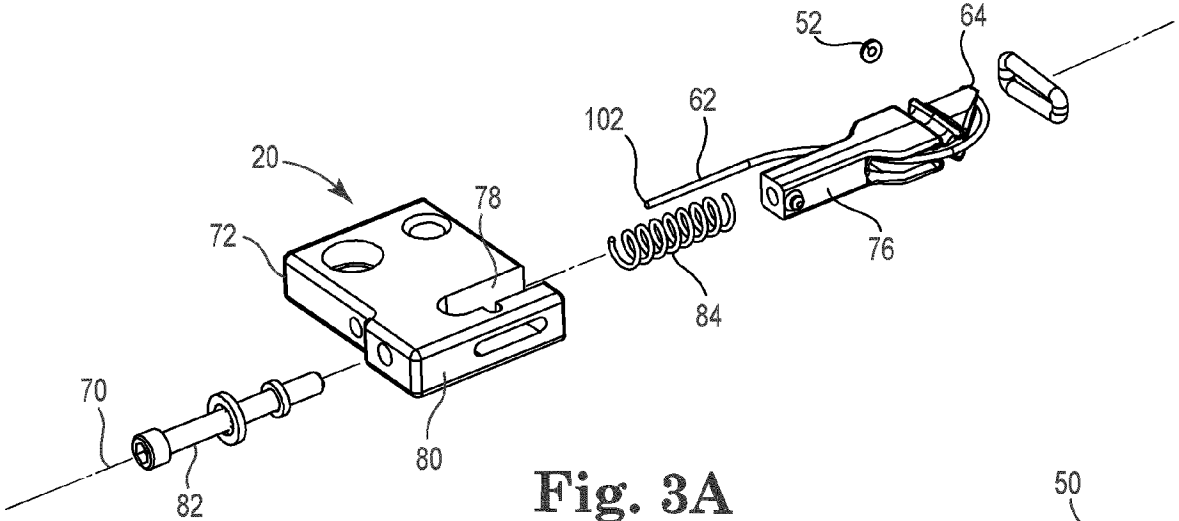
FIGS. 3A and 3B illustrate an eye alignment assembly in accordance with an embodiment of the present disclosure.
Figure 3B:
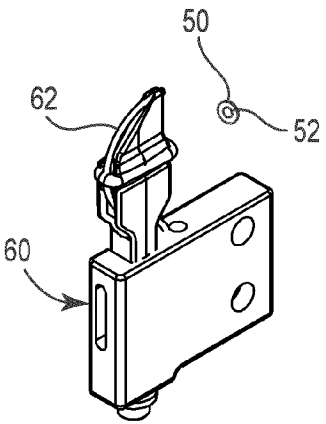
Figure 3C:
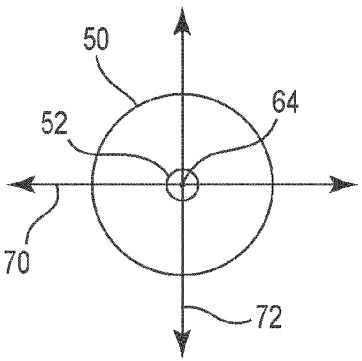
FIG. 3C is a plan view of alignment indicia relative to a point sight for the eye alignment assembly of FIG. 3B.

FIG. 3A illustrates an assembly 74 that permits adjustment along the axis 70. Slide portion 76 of the pin housing 60 slides in slot 78 of the support block 80. Adjustment screw 82 and spring 84 permit adjustment of the pin housing 60 and the phosphorescent optical fiber 62 along the axis 70.

Figure 3D:
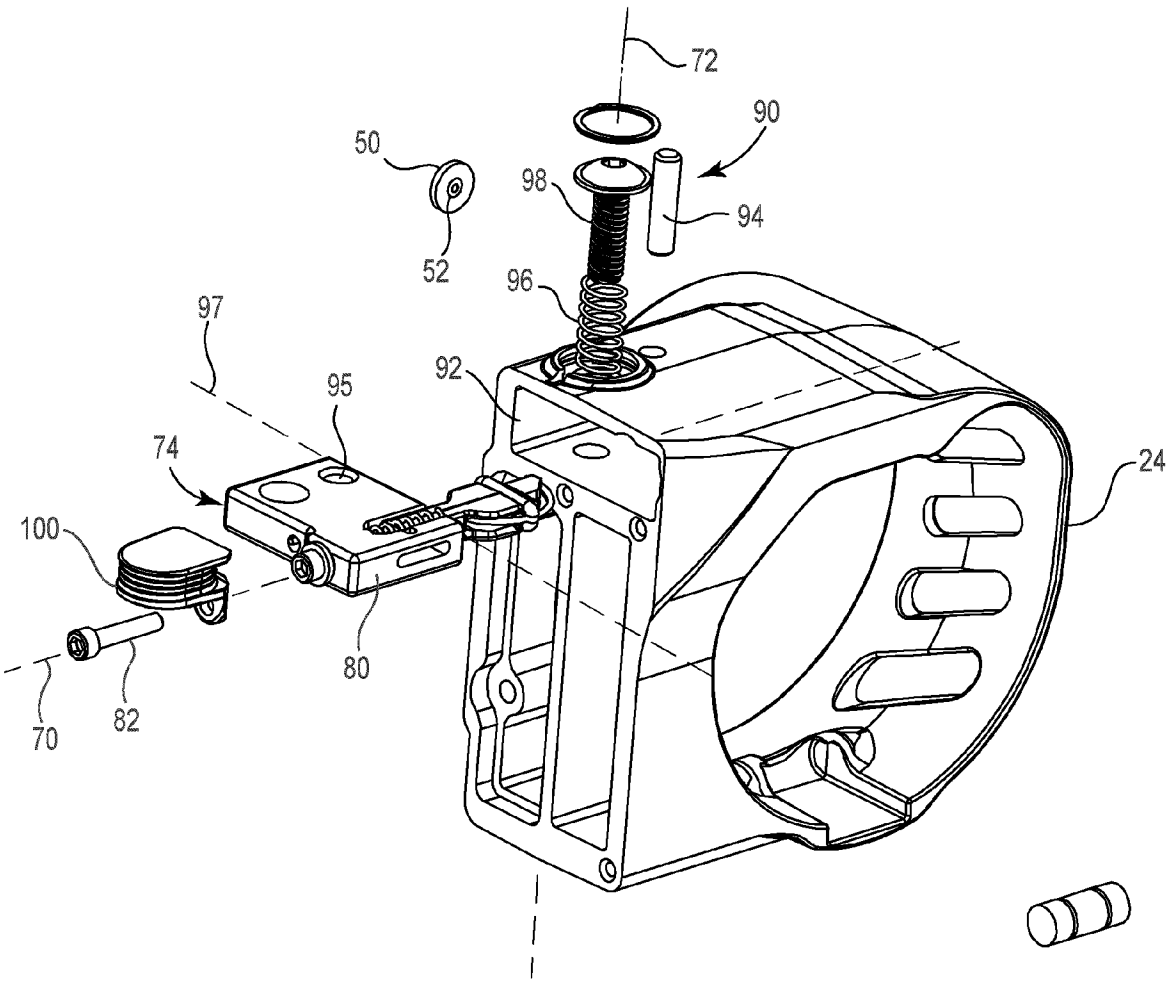
FIG. 3D is an exploded view of the eye alignment assembly of FIGS. 3A and 3B coupled to a sight in accordance with an embodiment of the present disclosure.

FIG. 3D illustrates adjustment mechanism 90 for the axis 72. The assembly 74 of FIG. 3A is positioned in recess 92 in the frame 24 so sight point 64 is located generally behind lens 50. Guide pin 94 retains the assembly 74 within the recess 92, but permits limited motion of the support block 80 along the axis 72 within the recess 92. Spring 96 biases the support block 80 toward the bottom of the recess 92, while screw 98 permit the support block 80 to be raised and lowered within the recess 92.

In one embodiment, the assembly 74 is permitted to rotate a small amount around guide pin 94 to adjust the distance between the sight point 64 and the lens 50. This feature permits the sensitivity of the eye alignment assembly 20 to be adjusted. In another embodiment, hole 95 in support block 80 is replaced with a slot (see e.g., slot 78) to permit forward and rearward movement of the assembly 74 along axis 97. An adjustment screw, such as the adjustment screw 82, can be provided for adjusting the location of the assembly 74 along the axis 97.

Rotating the screws 82, 98 moves the location of the sight point 64 relative to the indicia 52 on the lens 50 along the axes 70, 72 so the present eye alignment assembly 20 can be fine tuned for the particular shooting style, body shape, and other variable particular to the user.

The lens 50 can have a convex or a concave curvature on both of its sides, with the specific configuration of the lens variables, such as for example, the radii of curvature of the respective surfaces, the index of refraction, and the thickness of the lens, determining its characteristics, such as its focal length and magnification. By manipulating these variables, it is possible to create a lens 50 in which the alignment indicia 64 is not visible or not in focus when viewed by a human eye that is not in the proper or desired location relative to the sight 22. Therefore, it is possible to make an eye alignment assembly 20 with single alignment indicia.

In another embodiment, the lens 50 is coated with an opaque material that block light from the sight point 64, except in the center of the alignment indicia 52. Consequently, the user cannot see the sight point 64 unless he or her eye is in a predetermined relationship with respect to the sight 22. Luminescent material 100 is optionally optically coupled to proximal end 102 of the phosphorescent optical fiber 62.

Figure 4B:
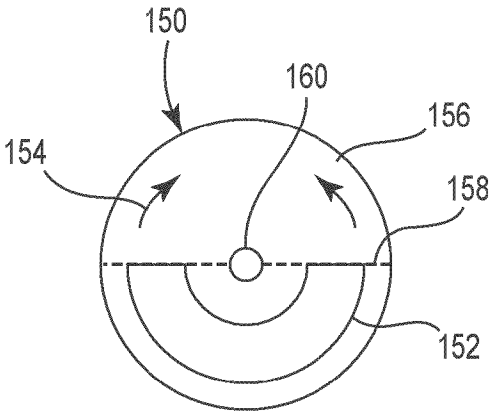
FIG. 4B is a plan view of alignment indicia for the eye alignment assembly of FIG. 4A.
Figure 4A:
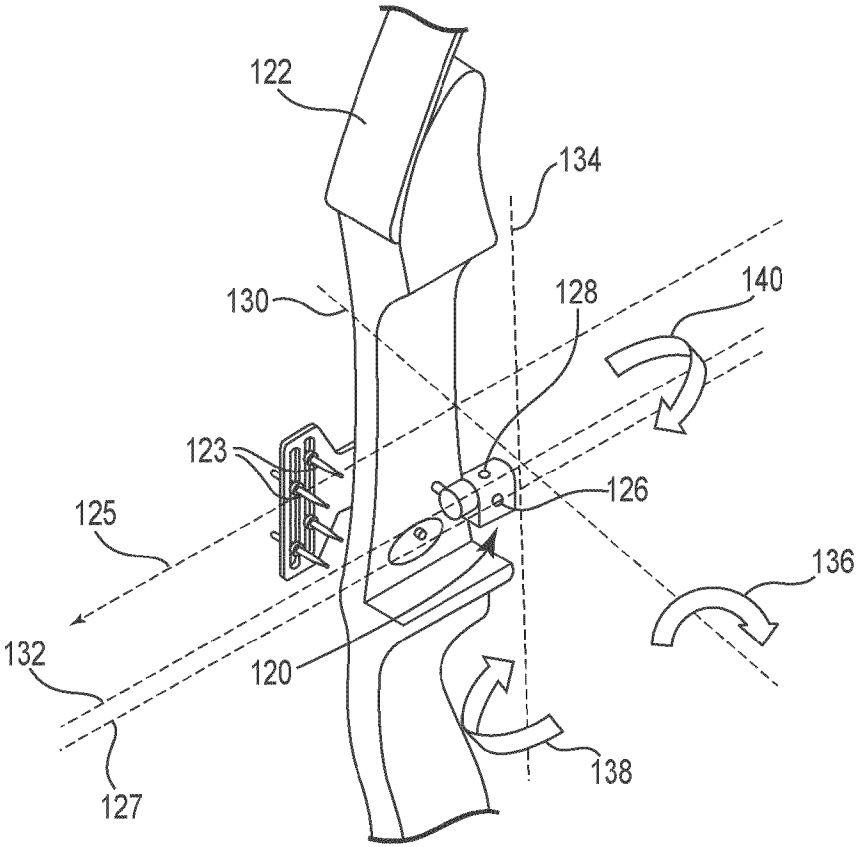
FIG. 4A is a perspective view of a bow with an eye alignment assembly in accordance with an embodiment of the present disclosure.

FIG. 4A illustrates an embodiment of an eye alignment assembly 120 combined with bow 122 in accordance with an embodiment of the present disclosure. In the illustrate embodiment, the eye alignment assembly 120 is fixedly mounted to bow 122. Alternatively, the eye alignment assembly 120 can be mounted to a bow sight. The eye alignment assembly 120 includes tubular housing 124 that contains an eye alignment assembly, such as illustrate in FIG. 3B.

In the illustrated embodiment, the bow 122 includes a series of sight pins 123 along with the user's line of sight 125 extends to a target. The operating axis/plane 127 of the bow 122, however, is located below the user's line of sight 125. The user's line of sight 125 is not co-linear with the operating axis/plane 127 of the bow 122.

Adjustment screws 126, 128 on the housing 124 permit adjustment of the position of the sight point 64 relative to alignment indicia 52 on the lens 50 along the axes 70, 72, as illustrated in FIG. 9C. The eye alignment assembly 120 can be adjusted to provide an indication of orientation of a user's eye, without needing to adjust the position of the housing 124.

The present eye alignment assembly 120 can provide an indication of the user's eye relative to the bow 122 in along the X-axis 130, the Y-axis 132, the Z-axis 134, as well as in pitch 136 and yaw 138 relative to the bow 122. Position along the Y-axis is typically proved by using a lens 50 with a particular focal length such that the sight point 64 is visible and/or in focus, only at a particular distance along the Y-axis 132. Roll position 140 is typically indicated by level 36.

FIG. 4B is a plan view of an alternate eye alignment assembly 150 that provided an indication of eye position in all six degrees of freedom in accordance with an embodiment of the present disclosure. In particular, indicia 152 is permitted to rotate 154 around center of lens 156 to provide an indication of the user's eye relative to the bow 122 in the roll direction 140 (i.e., rotation around the Y-axis 132). For example, the indicia 152 may be located in a cavity containing a fluid. Under the force of gravity the indicia 152 self-level as illustrated in FIG. 4B. Dashed line 158 on lens 156 provides an indication that the rotating indicia 152 is level (i.e., degree of rotation around the Y-axis 132) with respect to the eye alignment assembly 150. By using a lens 156 with a focal length that permits the sight point 160 to be visible and/or in focus only at a particular distance along the Y-axis 132, the eye alignment assembly 150 operates in all six degrees of freedom 130, 132, 134, 136, 138, 140.

Figure 14:
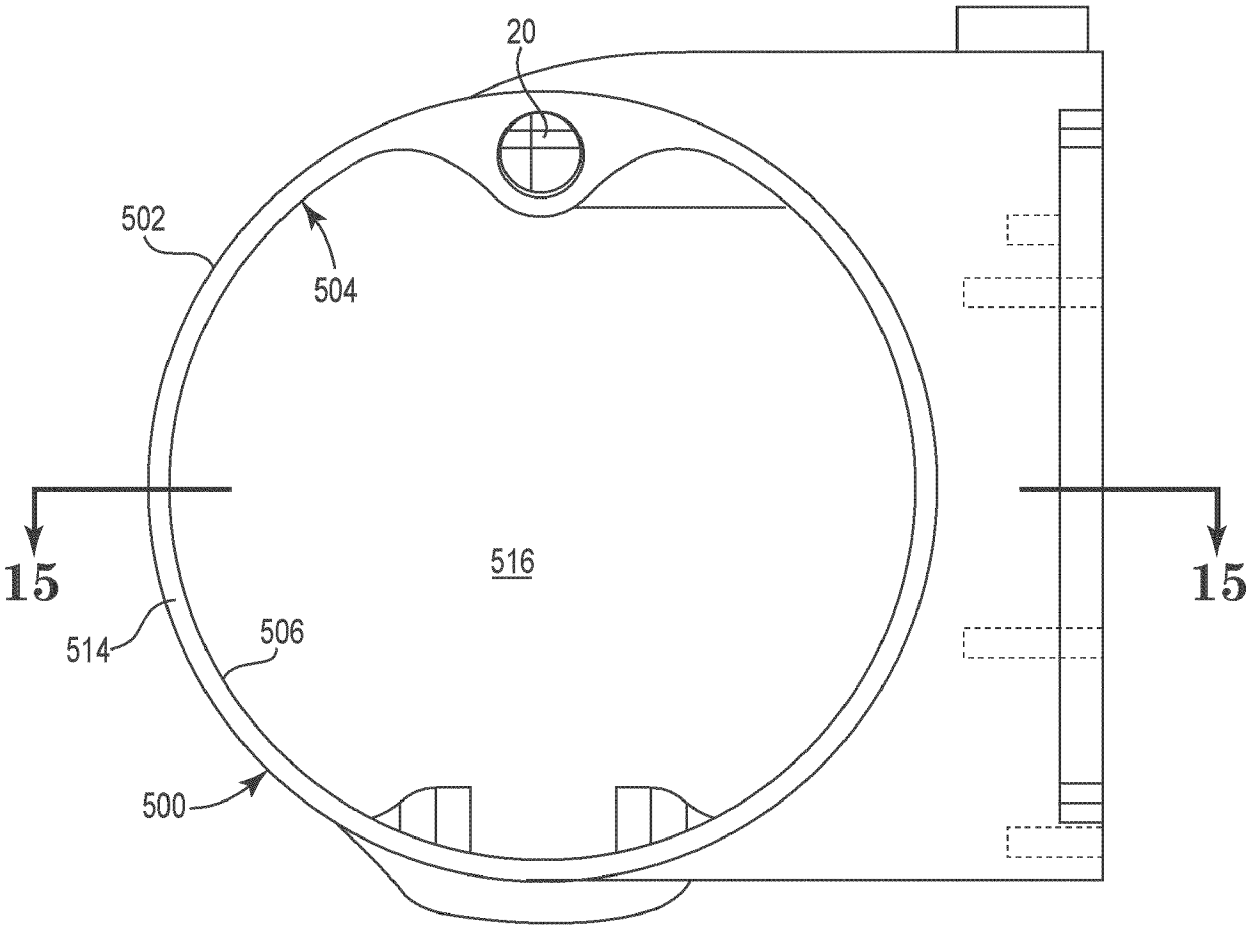
FIG. 14 is a front view of an alternate eye alignment assembly viewed from a user's perspective in accordance with an embodiment of the present disclosure.
Figure 15:
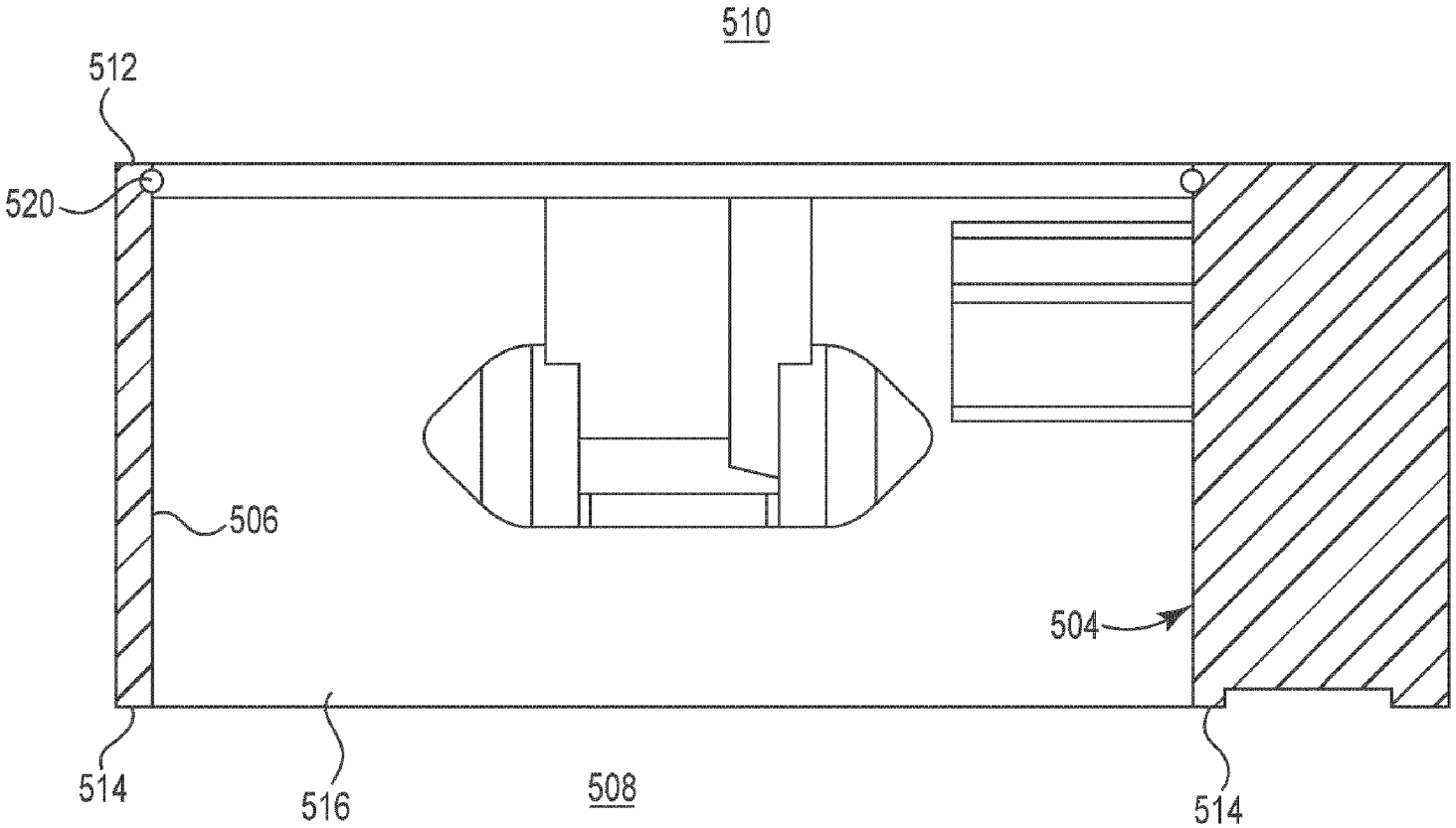
FIG. 15 is a cross-sectional view of the eye alignment assembly of FIG. 14.

FIGS. 14 and 15 illustrate an alternate bow sight 500 with a tapered frame 502 that operates as an eye alignment assembly 504 in accordance with an embodiment of the present disclosure. The frame 502 has a viewing opening 516 through which the user views the target. Inner wall 506 surrounding the viewing opening 516 tapers outward from leading edge 508 to trailing edge 510, being generally cone shaped. From the perspective of the shooter, trailing edge 512 of the frame 502 is substantially concealed behind the leading edge 514 when the frame 502 is located at a particular orientation relative to a user's eye.

The eye alignment assembly 504 is particularly useful for providing an indication of pitch and roll of the bow sight 500 relative to the user. Although the illustrated frame 502 has a generally circular cross-sectional shape, other non-circular shapes are possible. The frame 502 can also form a continuous or discontinuous structure around the viewing opening 516.

In one embodiment, indicia 520, such as for example, an optical fiber or an illuminated material, are located proximate trailing edge 512 of the frame 502 to assist the user in verifying that the bow sight 500 is in the desired location relative to the user's body. In particular, when the indicia 520 are substantially concealed behind the leading edge 514 of the frame 502, the bow sight 500 is correctly positioned relative to the user. Over time, the user learns to quickly and accurately position his or her body and shooting eye in the same position relative to the bow sight 500, allowing for consistent shooting.

The present eye alignment assembly 504 can be used alone or in combination with eye alignment assembly 20 discussed above. In one embodiment, the user initially positions the bow sight 500 (and hence the bow) using the eye alignment assembly 504 and then fine tunes positioning using the eye alignment assembly 20. For example, the tapered surface 506 can provide a course eye alignment function and the eye alignment assembly 20 a fine eye alignment function.

Figure 16:
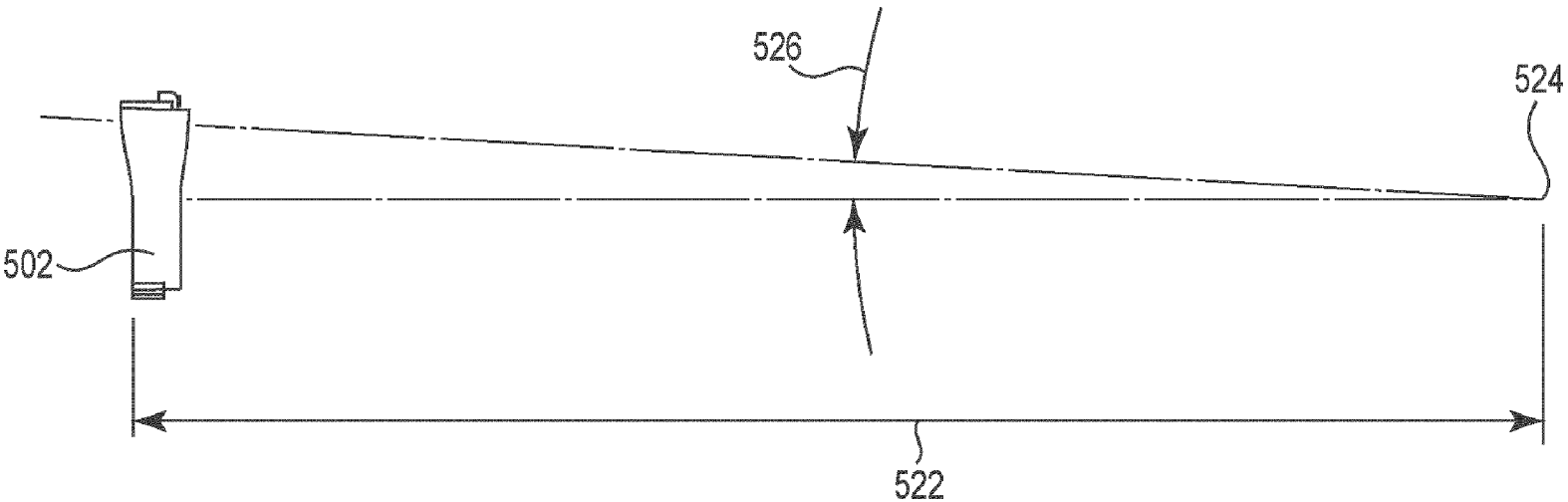
FIG. 16 is a schematic illustration of the eye alignment assembly of FIG. 14 relative to a user.

As illustrated in FIG. 16, the degree of taper of the inner surface 506 is typically a function of distance 522 between a user's eye 524 and the frame 502. The closer the user's eye 524 to the frame 502, the greater the required taper angle 526. For most bow sight applications, taper angle 526 is typically about 3 degrees to about 4 degrees. While the present embodiment is discussed in the context of the bow sight 500, any of the eye alignment assemblies disclosed herein can include a tapered frame to provide duplicate eye alignment functions.

The present bow sight 500 needs to be adjusted for the particular user's shooting style. The user preferably adjust primarily the pitch 136 and yaw 138 (see e.g., FIG. 4A) of the frame 502 using the adjustment features provided in the mounting assembly 21. Once the frame 502 is correctly positioned for the user, the eye alignment assembly 20, if provided, is adjusted as discussed above.

Figure 5:
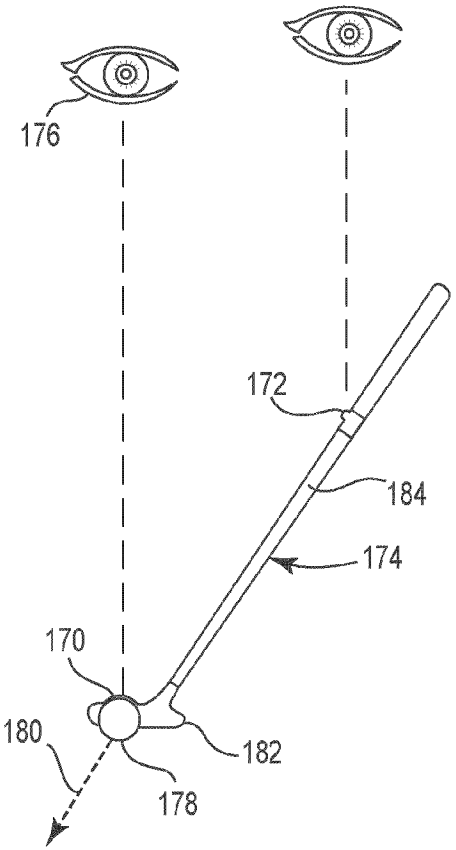
FIG. 5 is a side view of a golf putter with an eye alignment assembly in accordance with an embodiment of the present disclosure.

FIG. 5 illustrates an alternate eye alignment assemblies 170, 172 mounted on golf putter 174 in accordance with an embodiment of the present disclosure. When putting it is desirable for the user's eye 176 to be vertically over the golf ball 178 and in alignment with the desired path 180 of the ball 178. Eye alignment assembly 170 is preferably located on the club head 182 above the point of impact with the ball 178. Secondary eye alignment assembly 172 is optionally located on the club shaft 184 to provide an indication of the shaft orientation relative to the user.

Figure 6A:
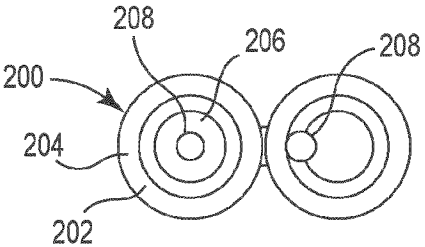
FIGS. 6A-6C illustrate alternate configurations of the eye alignment assembly in accordance with an embodiment of the present disclosure.

FIG. 6A illustrates an alternate eye alignment assembly 200 in accordance with an embodiment of the present disclosure. Indicia 202 on lens 204 is an annular ring. Secondary indicia 206 is located behind sight point 208. As illustrated in the left-hand frame, the alignment is achieved by centering the sight point 208 over the secondary indicia 206.

Figure 6B:
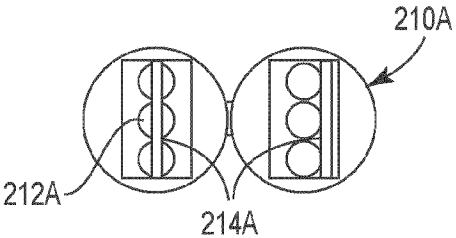
Figure 6C:
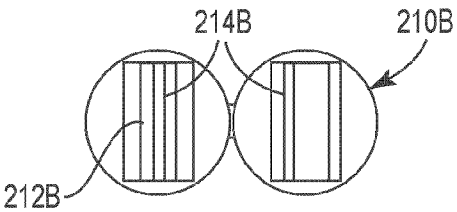

FIGS. 6B and 6C illustrate alternate eye alignment assemblies 210A, 210B in accordance with an embodiment of the present disclosure. Secondary indicia 212A, 212B are located behind sight lines 214A, 214B. The sight lines 214A, 214B can be a plurality of ends of phosphorescent optical fibers aligned to form a line structure or a side surface of a phosphorescent optical fiber treated to radiate light. As illustrated in the left-hand frame, the alignment is achieved by centering the sight lines 214A, 214B over the secondary indicia 212A, 212B.

Figure 7:
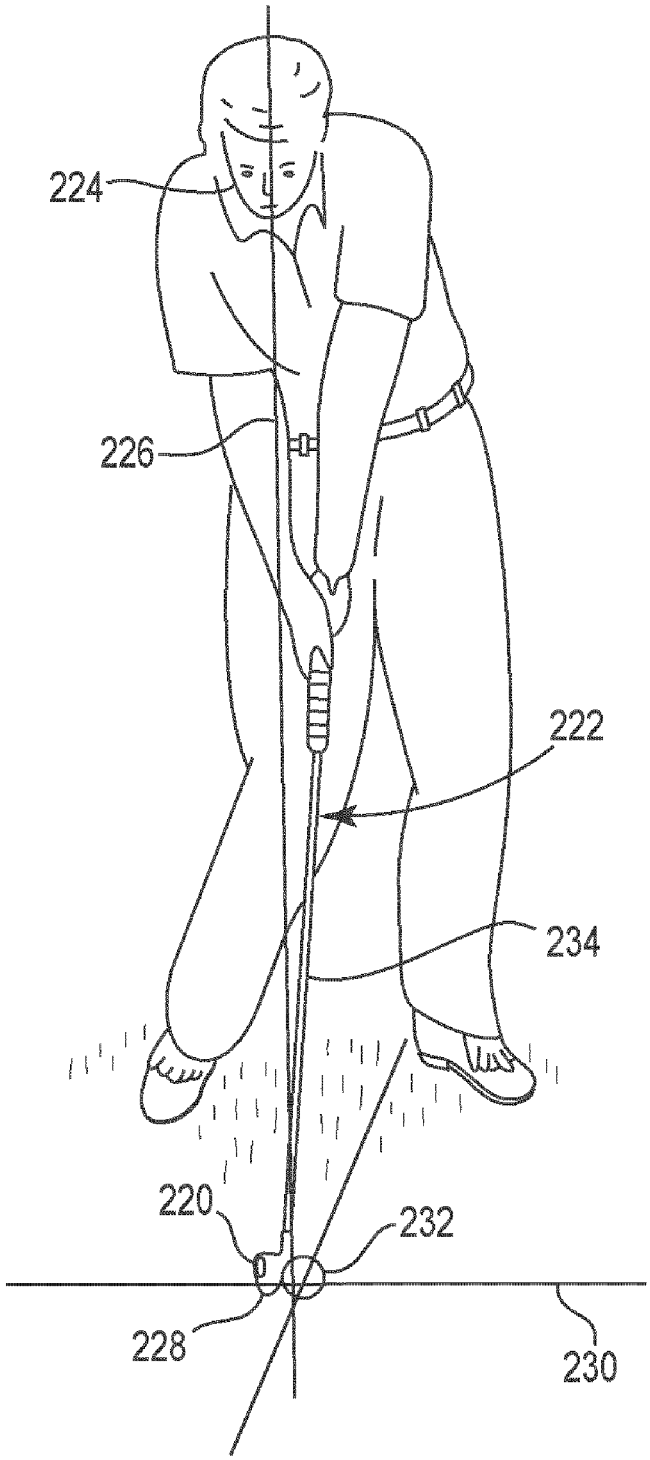
FIG. 7 is a perspective view of a golfer using an eye alignment assembly in accordance with an embodiment of the present disclosure.

FIG. 7 illustrates an eye alignment assembly 220 mounted to golf club 222 in accordance with an embodiment of the present disclosure. Wood or iron shots require that the golfer's eyes 224 be at a pre-determinable angle with respect to vertical 226. It is preferable that this angle remain constant for each club that the golfer uses. If the eyes 224 are not properly aligned with golf club head 228 for any given shot, a parallax problem is introduced, which is worse if the eyes 224 are not in the vertical plane 230 of the ball's 232 expected flight, where the vertical plane 230 corresponds to the operating axis/plane of the golf club 222. Parallax requires the golfer to continually make compensations from shot to shot, which introduce additional variables in the golf swing.

The eye alignment assembly 220 aligns with golfer's eyes 224 with respect to the club head 228 at the desired orientation. As a result, even inexperienced golfers can quickly learn to consistently position their body with respect to the golf club 222 and the ball 232, accelerating the learning process. In an alternate embodiment, the eye alignment assembly 220 is located on the shaft 234 of the golf club 222.

Figure 8:
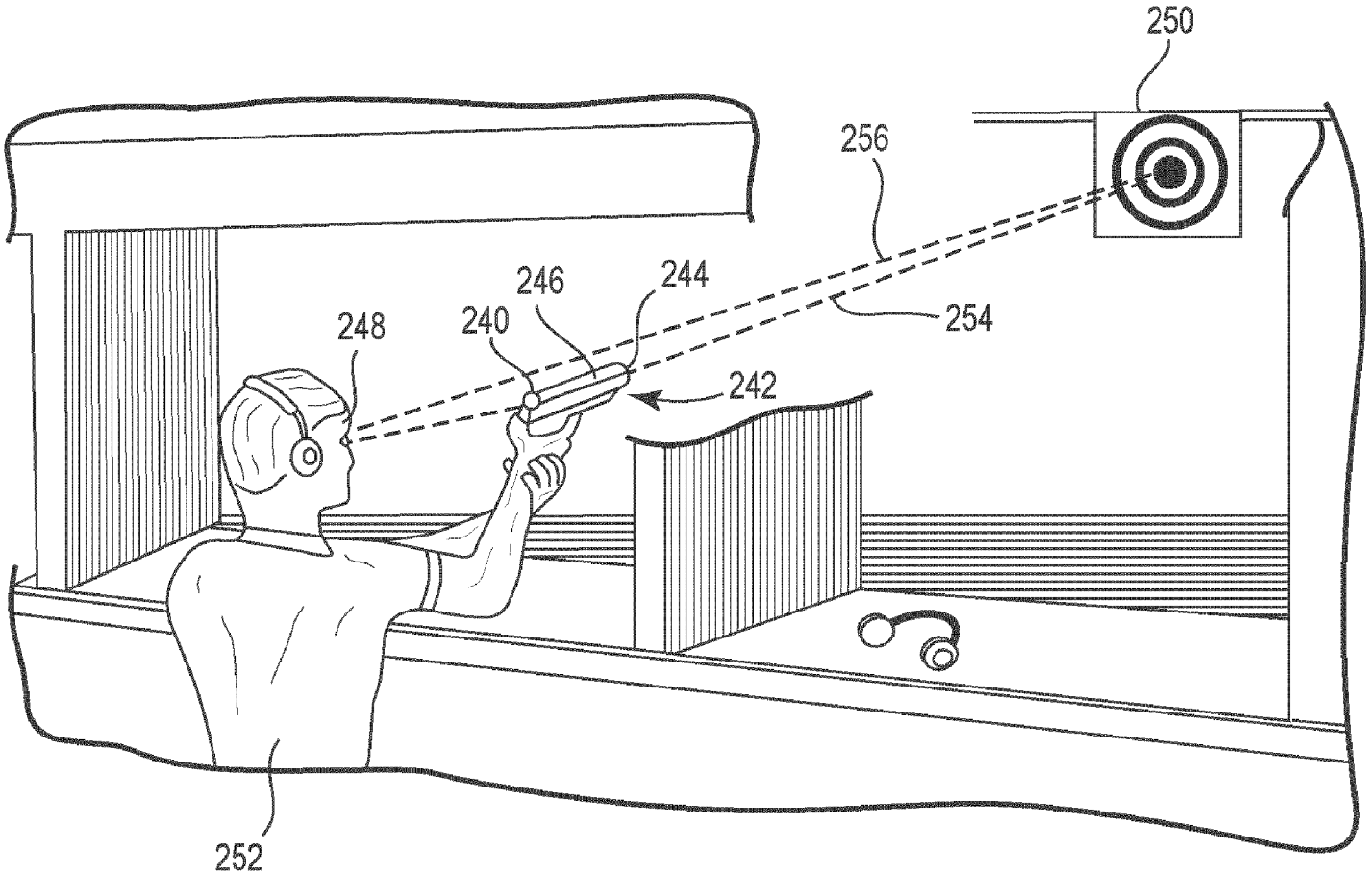
FIG. 8 is a perspective view of a shooter using an eye alignment assembly in accordance with an embodiment of the present disclosure.

FIG. 8 illustrates an eye alignment assembly 240 mounted to a firearm 242 in accordance with an embodiment of the present disclosure. Firearm 242 includes a conventional sight 244 on barrel 246 that is aligned with user's shooting eye 248. When sighting along the barrel 246, the user's line of sight is generally parallel to, and very close to, the operating axis/plane 254 of the firearm 242. In some circumstances, however, there may be insufficient time to sight the weapon 242 with the sight 244. The user 246 must simply point the weapon 242 at target 250 and fire.

The eye alignment assembly 240 permits the user 252 to practice orienting the firearm 252 at a fixed orientation with respect to his body 250. By properly adjusting the eye alignment assembly 252, operating axis/plane 254 of the firearm 242 converges at the target 250 with the user's line of sight 256. Over time muscle memory will be developed and the user 252 will be able to sight the weapon 242 without use of sight 244. The weapon 242 becomes an extension of the user's 252 body, greatly accelerating the aiming process.

The technique illustrated in FIG. 8 applies to any tool, whether sporting equipment or work tools, such as drills, routers, and the like. The user can either actively align his or her body with the tool using the eye alignment assembly or can rely on muscle memory developed from using the present eye alignment assembly as a reference guide.

Figure 9:
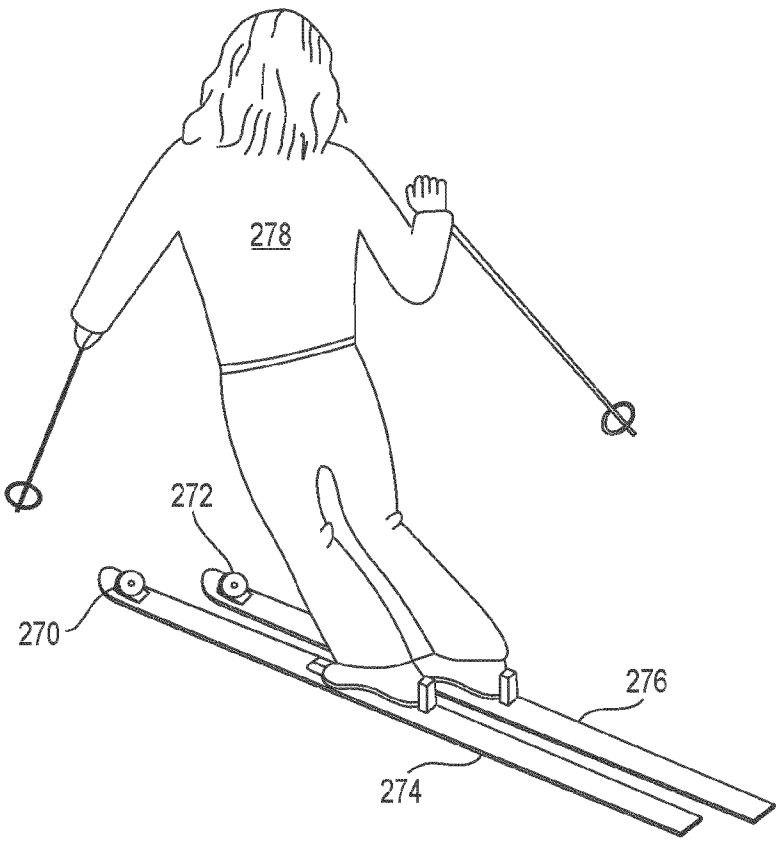
FIG. 9 is a perspective view of a skier using an eye alignment assembly in accordance with an embodiment of the present disclosure.

The present eye alignment assembly can also be used in dynamic interfaces with tools. FIG. 9 illustrates a pair of eye alignment assemblies 270, 272 mounted to tips of skis 274, 276. Each ski 274, 276 defines its own operating axis/plane with the snow. The eye alignment assemblies 270, 272 are adjusted to provide an indication of the user's 278 body position relative to the operating axes/planes of skis 274, 276.

Figure 10:
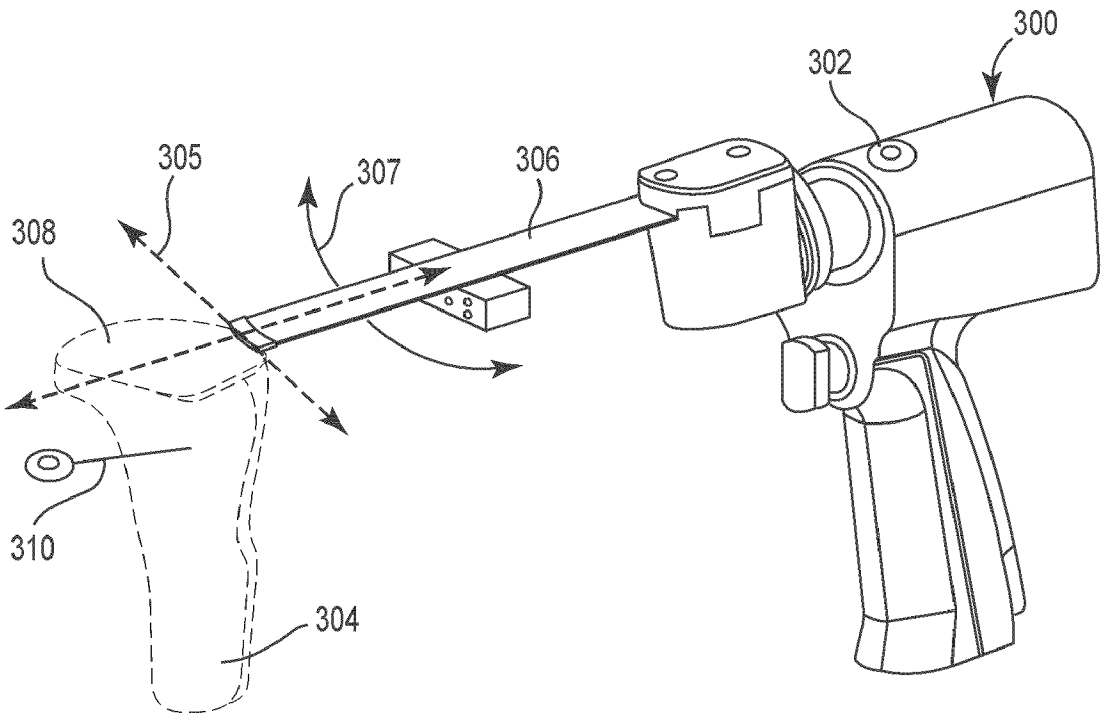
FIG. 10 is a perspective view of a power tool with an eye alignment assembly in accordance with an embodiment of the present disclosure.

FIG. 10 illustrates power tool 300 with an eye alignment assembly 302 in accordance with an embodiment of the present disclosure. In the illustrated embodiment, the power tool 300 is a battery powered oscillating saw 300 used to prepare bone 304 to receive an orthopedic implant. The operating axis/plane of the power tool 300 is plane 305 containing blade 306 during oscillates along arc 307.

Surgeons frequently prepare bones using such power tools 300 freehand, without a cutting guide. The present eye alignment assembly 302 provides an indication of the orientation of the blade 306 relative to the surgeon, without the surgeon needing to sight along the operating axis/plane 305 of the power tool 300.

In another embodiment, the orientation of the bone 304 is known and the eye alignment assembly 302 can be adjusted so the blade 306 is in the proper orientation to make the cut 308. In yet another embodiment, a second eye alignment assembly 310 is temporarily attached to the bone 304, such as by using a K-wire. The two eye alignment assemblies 302, 310 can be adjusted so the blade 306 is in the proper orientation relative to the bone 304.

Figure 11:
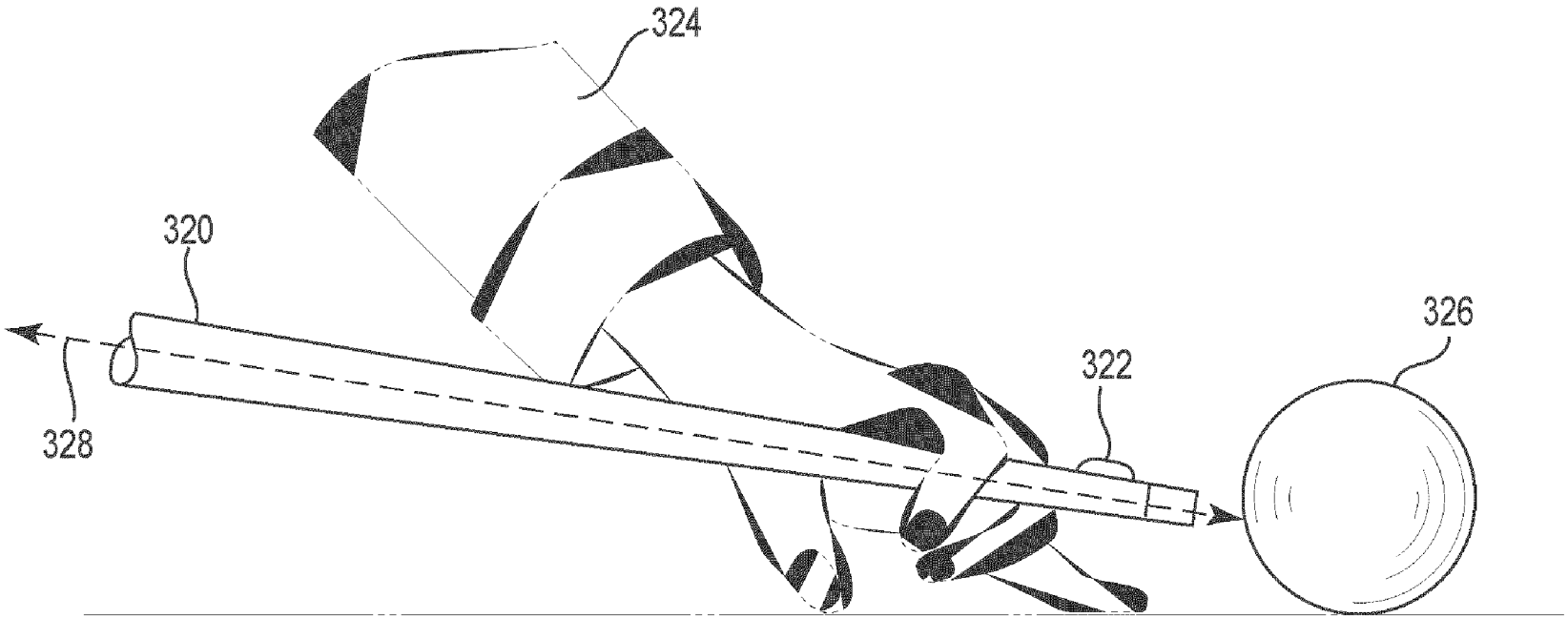
FIG. 11 is a side view of a pool cue with an eye alignment assembly in accordance with an embodiment of the present disclosure.

FIG. 11 illustrates a pool cue 320 with an eye alignment assembly 322 in accordance with an embodiment of the present disclosure. The eye alignment assembly 322 permits the user 324 to consistently and accurately position her body with respect to the pool cue 320 and the ball 326, without needing to sight along the operating axis/plane 328 of the pool cue 320.

Figure 12:
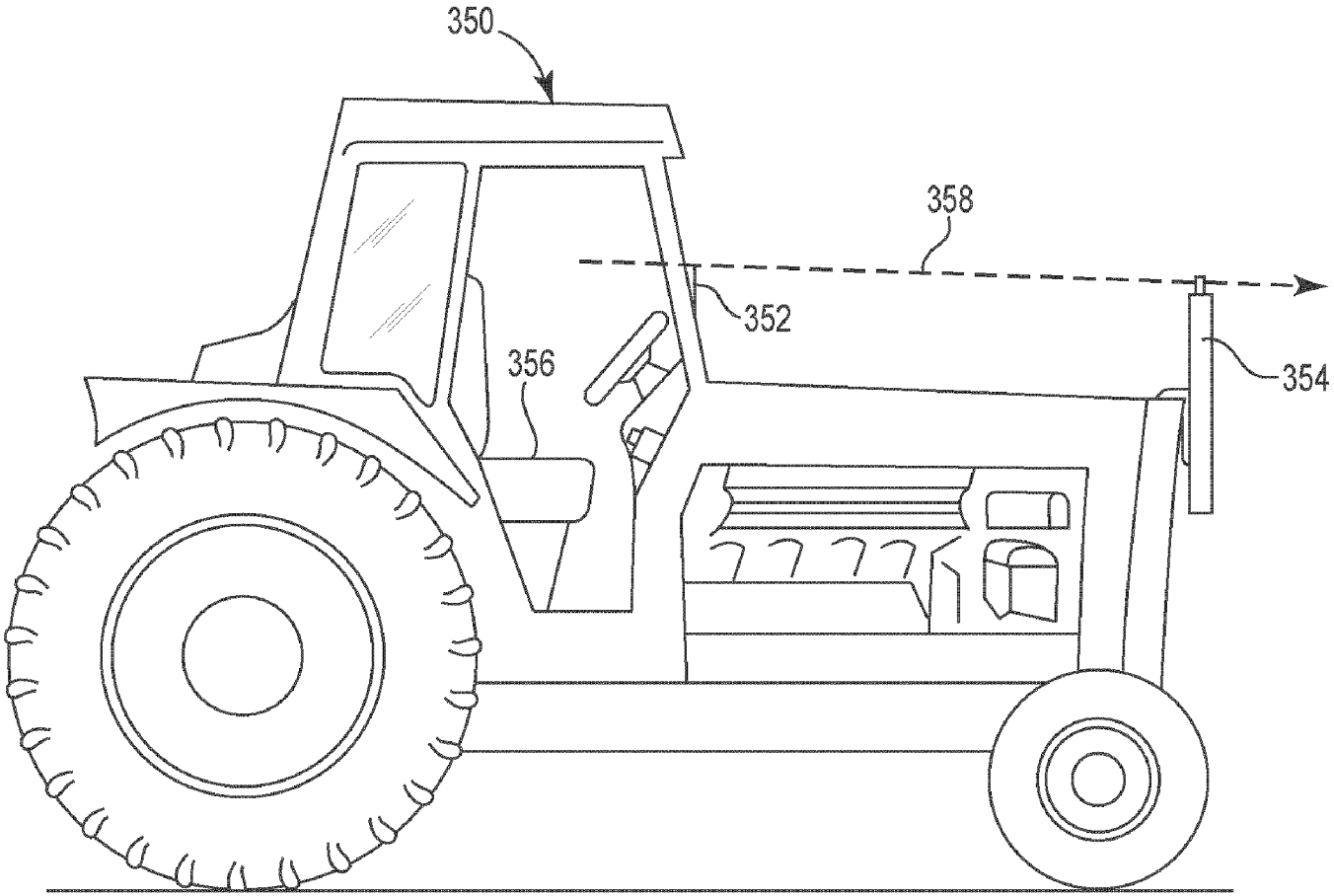
FIG. 12 is a side view of a tractor with an eye alignment assembly in accordance with an embodiment of the present disclosure.

FIG. 12 illustrates tractor 350 with an eye alignment assembly 352 in accordance with an embodiment of the present disclosure. Tractor users generally rely on a sighting device 354, such as for example a hood ornament, located at the end of the hood to center the tractor 350 relative to crop rows. This sighting approach is dependent on the user being consistently positioned relative to the sighting device 354. If the user moves in the seat 356, the alignment with the sighting device 354 changes and the tractor 350 can get off track. The present eye alignment assembly 352 provides the user an indication of her position relative to the tractor 350, so it is possible to consistently and accurately sight off the hood ornament 354. Consequently, the user's line of sight 358 is consistently positioned relative to the tractor 350 and the sighting device 354.

Figure 13:
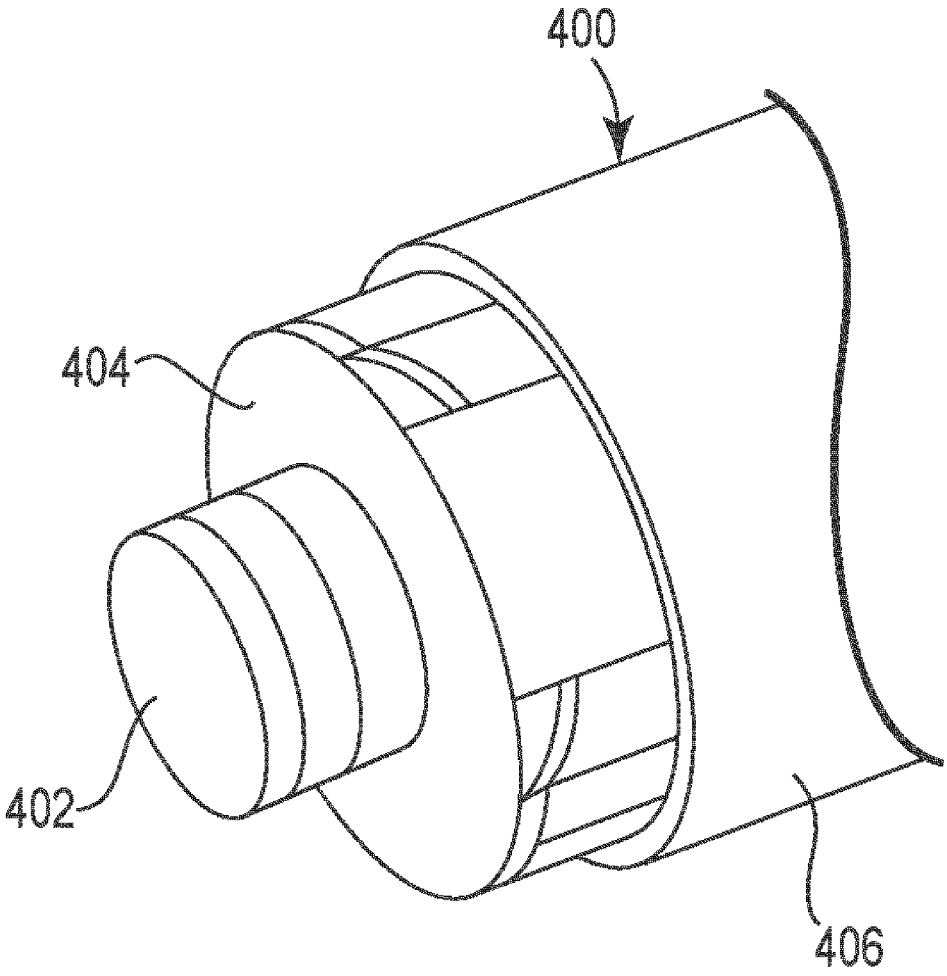
FIG. 13 is a perspective view of an exemplary phosphorescent optical fiber in accordance with an embodiment of the present disclosure.

FIG. 13 is a perspective view of a phosphorescent optical fiber 400 for use in the bow sight and eye alignment assembly of the present disclosure. Phosphorescence is a process in which electromagnetic energy is absorbed by a substance and then released relatively slowly in the form of visible light. The phosphorescent optical fiber 400 is preferably coextruded with core 402 that carries the light, cladding 404 that reflects the light back into the core, and an outer buffer coating 406 that protects the core and cladding from moisture, damage, etc. Suitable phosphorescent optical fibers are available from Nanoptics, Inc. of Gainesville, Fla. under model numbers 019GG-00S (green) and 019GR-00S (red). In another embodiment, an optional coating is applied on top of the buffer coating 406 to further smooth the fiber 400 and to reduce light scattering from the sides.

In one embodiment, phosphorescent material is incorporated into the material comprising the cladding 404 and/or the buffer layer 406 during the manufacturing process. Doping in the range of about 5% to about 20% has been found to be suitable for use in an eye alignment assembly of the present disclosure. A common phosphorescent material is strontium aluminate. Strontium aluminate based afterglow pigments are marketed under brand names like Super-LumiNova or NoctiLumina. Super-LumiNova is a strontium aluminate based non-radioactive and non-toxic photoluminescent or afterglow pigments for illuminating markings. This technology offers up to 10 times better brightness than previous zinc sulphide based materials.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A sighting device for a bow comprising:

a mounting bracket adapted to attached to the bow;

a frame attached to the mounting bracket, the frame comprising a leading edge oriented toward a user, a trailing edge oriented down range of the bow, and a tapered inner surface generally surrounding a viewing opening, the tapered inner surface tapering outward from the leading edge toward the trailing edge;

a plurality of sight pins comprising a plurality of sight points located in the viewing opening, the sight points configured to align the bow with a target viewed through the viewing opening; and an eye alignment assembly wherein the tapered inner surface is substantially concealed behind the leading edge when the frame is located at a particular orientation relative to the user's eye.

2. The sighting device of claim 1 wherein the eye alignment assembly provides an indication of orientation of the user relative to the bow in at least two degrees of freedom.

3. The sighting device of claim 1 wherein the eye alignment assembly provides an indication of orientation of the sighting device relative to the user's eye in pitch and yaw directions.

4. The sighting device of claim 1 wherein the eye alignment assembly decouples the user's line of sight from an operating axis/plane of the bow.

5. The sighting device of claim 1 wherein the eye alignment assembly provides an indication of orientation of the user relative to the bow without aligning the user's line of sight with an operating axis/plane of the bow.

6. The sighting device of claim 1 comprising indicia located proximate the trailing edge to assist the user in positioning the tapered inner surface substantially behind the leading edge.

7. The sighting device of claim 1 wherein the mounting bracket comprising:

a bow portion pivotally attached to the bow at a first location;

a slot in the bow portion;

a traveler located in the slot and attached to the bow at a second location, so the bow portion can pivot around the first location while the travel slides in the slot;

a spring biasing the bow portion is a first direction of rotation; and a set screw counteracting the bias of the spring to rotate the bow portion is a second opposite direction.

8. The sighting device of claim 1 comprising:

a secondary eye alignment assembly mounted to the frame, the secondary eye alignment assembly comprising a sight point of an optical fiber positioned a distance behind an alignment indicia on a lens; and an adjustment system adapted to reposition the sight point of the optical fiber relative to the alignment indicia on the lens, the secondary eye alignment assembly providing an indication of orientation of the user relative to the bow in at least two degrees of freedom.

9. The sighting device of claim 8 wherein the adjustment system permits the sight point of the optical fiber to be adjusted in at least two degrees of freedom relative to the lens.

10. The sighting device of claim 8 wherein the lens includes a magnification such that the sight point is only in focus when the lens is a predetermined distance from the user.

11. The sighting device of claim 8 wherein the alignment indicia rotates relative to the lens to provide an indication of level.

12. The sighting device of claim 8 wherein the alignment indicia on the lens is aligned with the sight point on the optical fiber only when the user is in a predetermined relationship with respect to the bow.

13. The sighting device of claim 8 wherein the secondary eye alignment assembly comprises an indication of the user's position relative to the bow in six degrees of freedom.

14. A sighting device for a tool comprising:

a mounting bracket adapted to attached to the tool; and a frame attached to the mounting bracket, the frame comprising a leading edge oriented toward a user, a trailing edge oriented away from the user, and a tapered inner surface generally surrounding a viewing opening, the tapered inner surface tapering outward from the leading edge toward the trailing edge, wherein the tapered inner surface is substantially concealed behind the leading edge when the frame is located at a particular orientation relative to the user's eye.

15. The sighting device of claim 14 wherein the tool is selected from one of a bow, a firearm, a golf club, power tools, pool cue, tractor, or snow skis.

16. A method of aligning a bow with a user, the method comprising the steps of:

mounting an eye alignment assembly to the bow, the eye alignment assembly comprising a frame with a leading edge oriented toward a user, a trailing edge oriented down range of the bow, and a tapered inner surface generally surrounding a viewing opening, the tapered inner surface tapering outward from the leading edge toward the trailing edge;

positioning the bow so the tapered inner surface is substantially concealed behind the leading edge;

aligning a sight point located in the viewing opening with a target; and firing the bow.

17. The method of claim 16 wherein the eye alignment assembly provides an indication of orientation of a user relative to the bow in at least two degrees of freedom.

* * * * *